US008261850B2

(12) United States Patent
Fuchs

(10) Patent No.: US 8,261,850 B2
(45) Date of Patent: Sep. 11, 2012

(54) HAND-HELD ROTARY HAMMER POWER TOOL

(75) Inventor: Rudolf Fuchs, Neuhausen (DE)

(73) Assignee: Robert Bosch GmbH, Stuttgart (DE)

( * ) Notice: Subject to any disclaimer, the term of this patent is extended or adjusted under 35 U.S.C. 154(b) by 224 days.

(21) Appl. No.: 12/521,348

(22) PCT Filed: Oct. 30, 2007

(86) PCT No.: PCT/EP2007/061689

§ 371 (c)(1),
(2), (4) Date: Jun. 26, 2009

(87) PCT Pub. No.: WO2008/080664

PCT Pub. Date: Jul. 10, 2008

(65) Prior Publication Data

US 2011/0000693 A1 Jan. 6, 2011

(30) Foreign Application Priority Data

Dec. 27, 2006 (DE) ..... 10 2006 061 625

(51) Int. Cl.
*B25D 17/00* (2006.01)

(52) U.S. Cl. ..... 173/117; 173/217; 173/90

(58) Field of Classification Search ..... 173/117, 173/217, 90
See application file for complete search history.

(56) References Cited

U.S. PATENT DOCUMENTS

| | | | | |
|---|---|---|---|---|
| 2,815,834 | A | 12/1957 | Mall | |
| 4,487,272 | A * | 12/1984 | Bleicher et al. | 173/48 |
| 4,719,976 | A * | 1/1988 | Bleicher et al. | 173/109 |
| 5,251,706 | A * | 10/1993 | Evans | 173/29 |
| 5,533,581 | A | 7/1996 | Barth et al. | |
| 5,784,934 | A * | 7/1998 | Izumisawa | 81/57.26 |
| 6,202,763 | B1 * | 3/2001 | Gude et al. | 175/135 |
| 6,491,111 | B1 * | 12/2002 | Livingston et al. | 173/93.5 |
| 6,508,313 | B1 * | 1/2003 | Carney et al. | 173/1 |
| 7,055,622 | B2 * | 6/2006 | Bone | 173/217 |
| 7,080,578 | B2 * | 7/2006 | Izumisawa | 81/57.39 |
| 7,156,187 | B1 | 1/2007 | Townsan | |
| 7,395,872 | B2 * | 7/2008 | Duesselberg et al. | 173/48 |
| 2007/0144752 | A1 * | 6/2007 | Pozgay et al. | 173/216 |
| 2008/0142237 | A1 * | 6/2008 | Fuchs | 173/104 |

FOREIGN PATENT DOCUMENTS

| | | | |
|---|---|---|---|
| CH | 362901 | | 6/1962 |
| CN | 2426395 | Y | 9/2004 |
| DE | 4116343 | A1 | 11/1992 |
| EP | 0583710 | A1 | 2/1994 |
| WO | 2006124288 | A2 | 11/2006 |

* cited by examiner

*Primary Examiner* — Brian D Nash
(74) *Attorney, Agent, or Firm* — Ronald E. Greigg

(57) ABSTRACT

The invention relates to a striking mechanism of a handheld electric power tool, in particular a percussion drill and/or percussion hammer, having a hammer cylinder, a piston mounted with a guide section inside the hammer cylinder in a longitudinally displaceable manner, and a piston outer guide on which a guide area of the piston is guided in a longitudinally displaceable manner. A piston end located outside the hammer cylinder comprises an overlap for overlapping an end area of the hammer cylinder, and the guide area at least partially belongs to the overlap or is affixed there.

20 Claims, 3 Drawing Sheets

HAND-HELD ROTARY HAMMER POWER TOOL

CROSS-REFERENCE TO RELATED APPLICATION

This application is a 35 USC 371 application of PCT/EP 2007/061689 filed on Oct. 30, 2007.

BACKGROUND OF THE INVENTION

1. Field of the Invention

The invention relates to a striking mechanism of an electric handheld power tool, in particular a rotary and/or percussion hammer.

2. Description of the Prior Art

An electric hand-held power tool of this kind is known, for example, as a rotary hammer. Rotary hammers in lower weight classes are most often embodied in pistol form. This is characterized by the motor axis of an electric drive motor extending parallel to the working spindle to which a tool, for example a drill bit, can be coupled. The pistol design is characterized by a relatively large overall length. Rotary hammers with an L design have a shorter overall length than those with the pistol design. The L design is characterized by the motor axis of the electric drive motor extending at an angle to the working spindle. For some applications, however, even the shorter overall length of the rotary hammer with the L design is still too large. If there is sufficient space available offset from the drilling axis, then an angled drilling head equipped for hammering transmission (angled hammer drilling head) is used as an attachment. There are known angled hammer drilling heads, which can be mounted as needed onto the rotary hammer and which transmit both the rotation and the hammering motion by 90°. In the known angled hammer drilling head, the hammering motion of the impact mechanism is transmitted to a striking pin with a 45° bevel. Due to the significant friction losses at the bevels that slide against each other, this transmission of force requires a high degree of production precision and the use of high-cost tool steels. Due to the powerful heating that occurs during operation, the hammering transmission of the angled drilling head is accompanied by a low efficiency. In addition, the mechanically rigid angled transmission permits there to be only one fixed drive output angle, thus limiting a universal applicability. In addition, the rigid angled transmission does not have a complete impact decoupling, therefore requiring the operator to exert a more powerful manual pressure in the drilling direction. This results in considerable operating disadvantages.

OBJECT AND ADVANTAGES OF THE INVENTION

The object of the invention is to create an electric handheld power tool whose overall length can be reduced. To that end, a center axis of a shaft of the transmission or a center axis of a drive shaft of the drive motor constitutes a pivot axis around which the drive motor can be pivoted in order to reduce the overall length of the electric handheld power tool. The pivotability of the drive motor permits a reduction in overall length both of an electric handheld power tool with a pistol design—in which the center axis of the drive shaft of the drive motor extends parallel to the working spindle—and of an electric handheld power tool with an L design—in which the drive shaft of the drive motor extends at an angle to the working spindle. In this context, "overall length" is understood to mean the space available in the working direction, i.e. in the direction that the working spindle is oriented. The possibility of pivoting the drive motor around the pivot axis in relation to the working spindle and impact mechanism permits an infinitely variable angle setting within a large angular range. The pivoting around the pivot axis established by the center axis of a shaft of the transmission or the drive shaft of the drive motor permits a hammering or hammer drilling operation without hammering energy losses due to a change in the hammering direction, despite the pivoting action. The pivoting makes it possible to implement an overall length that is short enough to permit access to very cramped locations. The device is ready for immediate use because no additional parts have to be mounted. Another advantage of the electric handheld power tool according to the invention is a small width across corners since the width across corners is largely independent of the diameter of the drive motor. Preferably, the electric handheld power tool is a rotary hammer and/or percussion hammer. It can be a pure rotary hammer, a rotary hammer for drilling and/or chiseling operation (combination hammer), or a pure percussion hammer.

In particular, the electric handheld power tool has a housing that is composed of a drive housing part containing the drive motor and an impact mechanism housing part containing the working spindle and the impact mechanism. The working spindle and the impact mechanism are mounted in the impact mechanism housing part and the drive motor is mounted in the drive housing part. There is thus a first machine unit of the electric handheld power tool, which has the impact mechanism housing part, impact mechanism, and spindle, and a second machine unit of the electric handheld power tool, which has the drive housing part and drive motor and is able to pivot around the pivot axis in relation to the first machine unit.

The transmission is advantageously associated with the drive housing part and the impact mechanism housing part. As a result, the transmission is part of both the first machine unit and the second machine unit of the electric handheld power tool. In this case, there are in particular components of the transmission that are exclusively associated with the first machine unit and other components that are exclusively associated with the second machine unit.

According to a modification of the invention, the electric handheld power tool has a hinge, which is provided between the drive housing part and the impact mechanism housing part to allow the drive motor to pivot. The hinge is composed, for example, of two swivel bearings.

In particular, the working spindle and impact mechanism have a common movement axis around which the working spindle rotates and/or along which a hammering mass of the impact mechanism moves. A common movement axis of the rotation and hammering operation is implemented, for example, in an electric handheld power tool embodied in the form of a rotary hammer; for example, the hammering mass is a component of a reciprocating striking element.

The movement axis is advantageously situated perpendicular to the pivot axis. The perpendicular arrangement optimally selects the pivot axis for shortening the overall length.

According to a modification of the invention, the center axis of the drive shaft is arranged perpendicular to a pivoting plane of the drive motor. The pivoting plane is the plane perpendicular to the pivot axis in which the drive motor is pivoted. This embodiment of the electric handheld power tool according to the invention is an electric handheld power tool with an L design.

Alternatively, the center axis of the drive shaft is arranged parallel to a pivoting plane of the drive motor. With a parallel arrangement of the center axis of the drive shaft, the electric handheld power tool is in particular an electric handheld power tool with a pistol design.

According to another embodiment, a component, in particular a hammer tube, of the impact mechanism constitutes the drive spindle or constitutes part of the drive spindle. The rotary drive of the tool is consequently carried out by means of a component of the impact mechanism. In particular, this component is the hammer tube of the impact mechanism.

tric handheld power tool has at least one clutch for selectively connecting the drive motor to the working spindle and/or to the impact mechanism. If there are two separate drive paths, for example, for driving the impact mechanism and the working spindle, each with a clutch embodied as a separating clutch, then it is possible to selectively implement a rotating and/or hammering operation of the electric handheld power tool.

BRIEF DESCRIPTION OF THE DRAWINGS

The invention will be explained in greater detail below in conjunction with the drawings.

DESCRIPTION OF THE PREFERRED EMBODIMENTS

Figure 1:
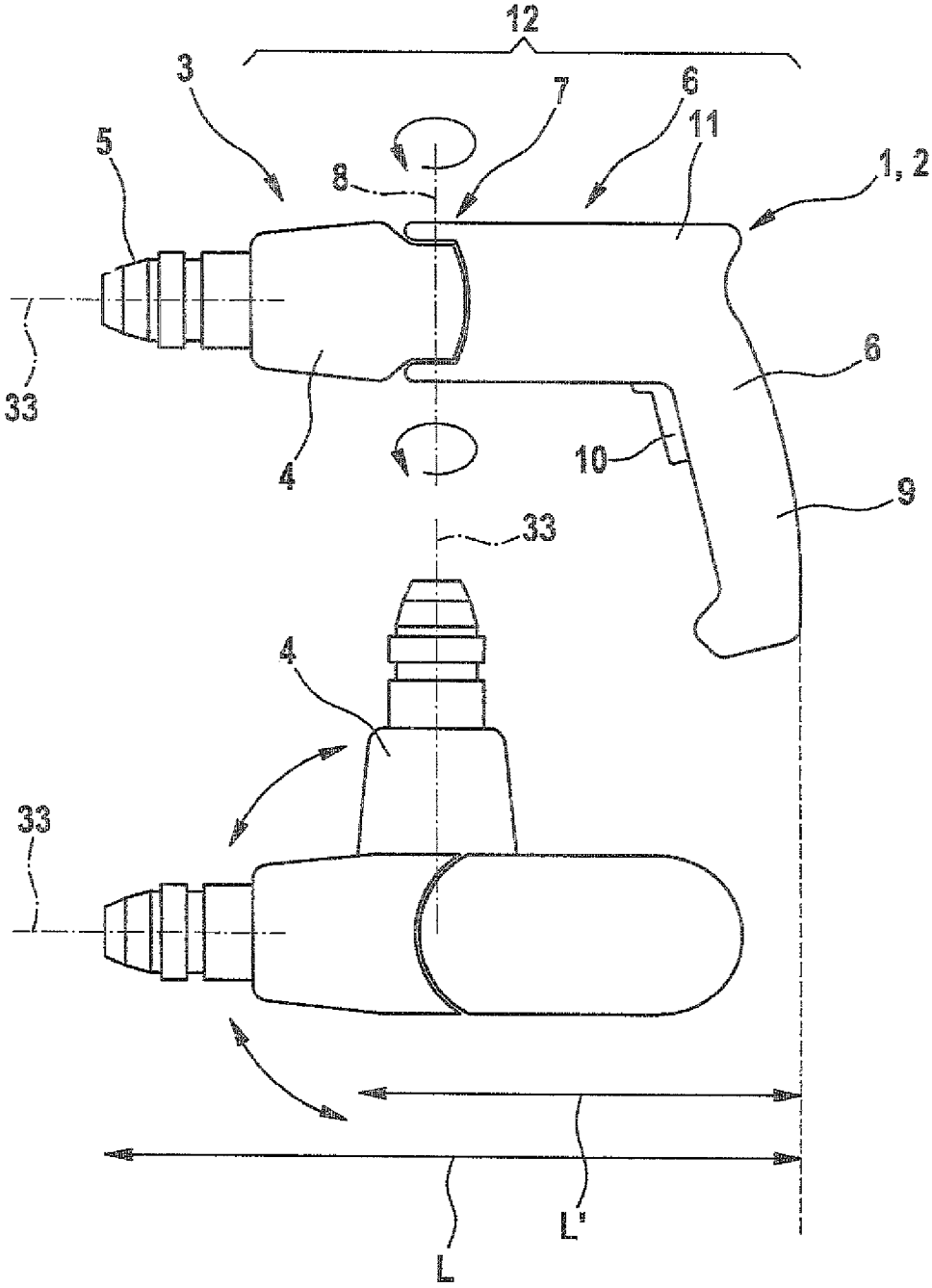
FIG. 1 shows an electric handheld power tool according to the invention in a pistol design.

FIG. 1 shows an electric handheld power tool 2, embodied in the form of a rotary hammer 1, with a pistol design. The side view in FIG. 1 (top) of the electric handheld power tool 2 shows the first machine unit 3 with an impact mechanism housing part 4 and the tool holder 5. The first machine unit 3 is connected by means of a hinge 7 to a second machine unit 6 of the electric handheld power tool 2 so that the second machine unit 6 can be pivoted in relation to the first machine unit 3 (or the first machine unit 3 can be pivoted in relation to the second machine unit 6) around a pivot axis 8. The second machine unit 6 has a handle 9 of a drive housing part 11, which handle is typical of a pistol design and is equipped with an actuating switch 10. The impact mechanism housing part 4 and the drive housing part 11 together constitute the housing 12 of the electric handheld power tool 2 according to the invention. The top view in FIG. 1 (bottom) shows the pivoting of the two machine units 3, 6. Next to a basic arrangement with the overall length L, which corresponds to a design of a conventional electric handheld power tool, a first machine unit 3 is shown, which is pivoted by an angle of 90° in relation to the second machine unit 6, thus yielding a reduced overall length L.

Figure 2:
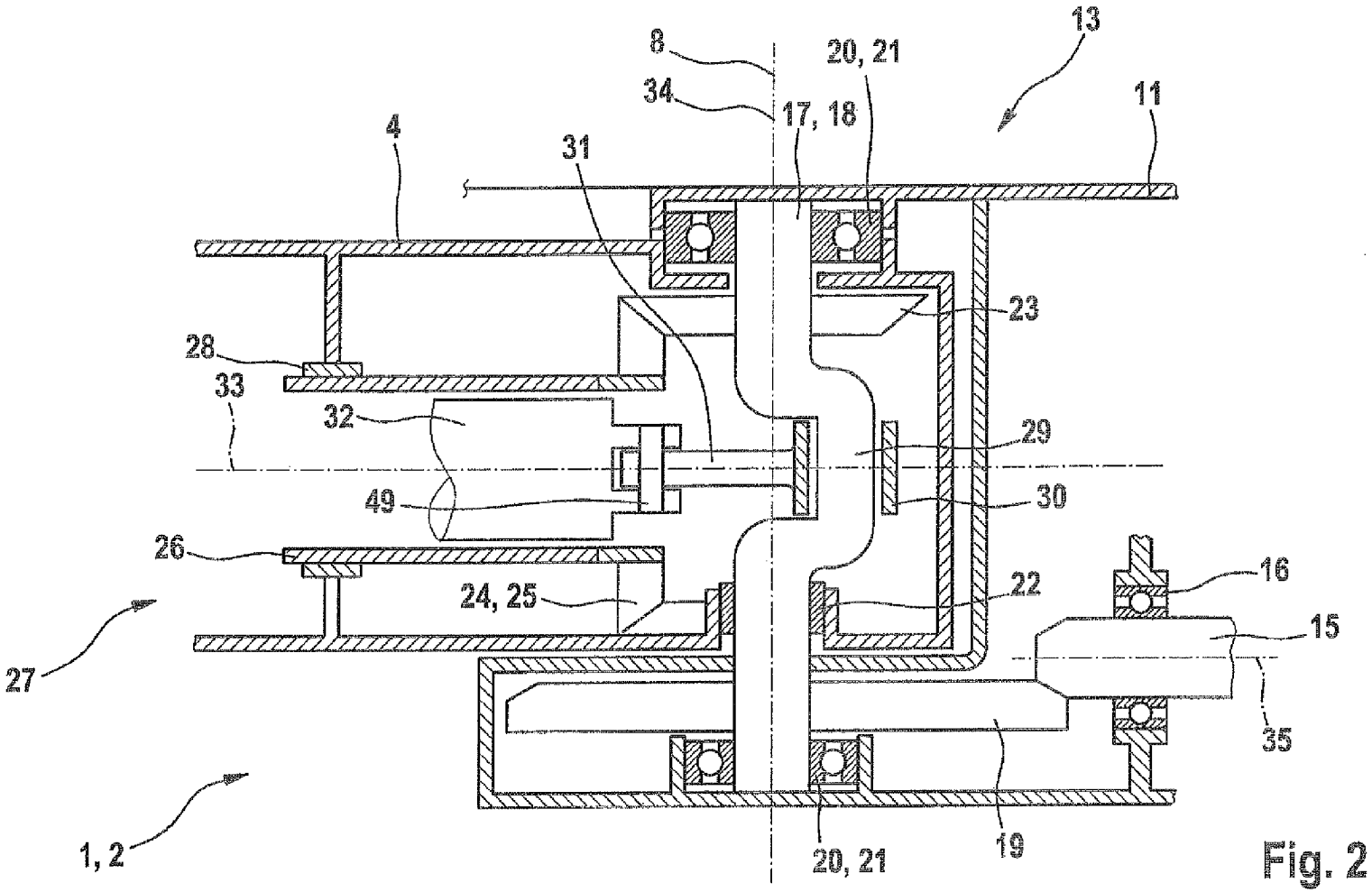
FIG. 2 shows a detail of an electric handheld power tool according to the invention in the region of the transmission in a first exemplary embodiment.

FIG. 2 shows the design of a transmission 13 for implementing the electric handheld power tool 2 according to the invention. The drive housing part 11 accommodates an only partially depicted drive motor with a drive shaft 15. The drive shaft 15 is supported by means of a shaft bearing 16 affixed to the housing. The drive shaft 15 drives a ring gear 19 that is fixed for co-rotation on a shaft 18 embodied in the form of a crankshaft 17. The term "ring gear" used here and below is understood to be a ring gear with a bevel gearing. The crankshaft 17 is supported in a bearing 21 embodied as a shaft bearing 20 in the drive housing part 11 and in the impact mechanism housing part 4. Another bearing 22 is mounted on the crankshaft 17 in order to support the impact mechanism housing part 4. Another ring gear 23 that is fixed to the crankshaft 17 for co-rotation meshes with a ring gear 24, which, functioning as a working spindle drive element 25 of the drive spindle, drives a hammer tube 26 of an impact mechanism 27. The hammer tube 26 is supported against the impact mechanism housing part 4 by means of a bearing 28. The rotary motion of the crankshaft 17 also functions as the drive for the impact mechanism 27. A cranked arm 29 of the crankshaft 17, together with a connecting rod 31 mounted on a bearing 30, converts the rotary motion into a reciprocating motion of a piston 32 of the impact mechanism 27. In the impact mechanism 27, the piston 32 drives a striking element, not shown, along a movement axis 33 via an air cushion, not shown. In an electric handheld power tool 2 embodied in the form of a rotary hammer, the movement axis 33 simultaneously constitutes the rotation axis of the drive spindle. The center axis 34 of the shaft 18 of the transmission 13, which shaft is embodied as a crankshaft 17, constitutes the pivot axis 8 around which the drive motor is able to pivot in order to reduce the overall length of the electric handheld power tool 2.

Figure 3:
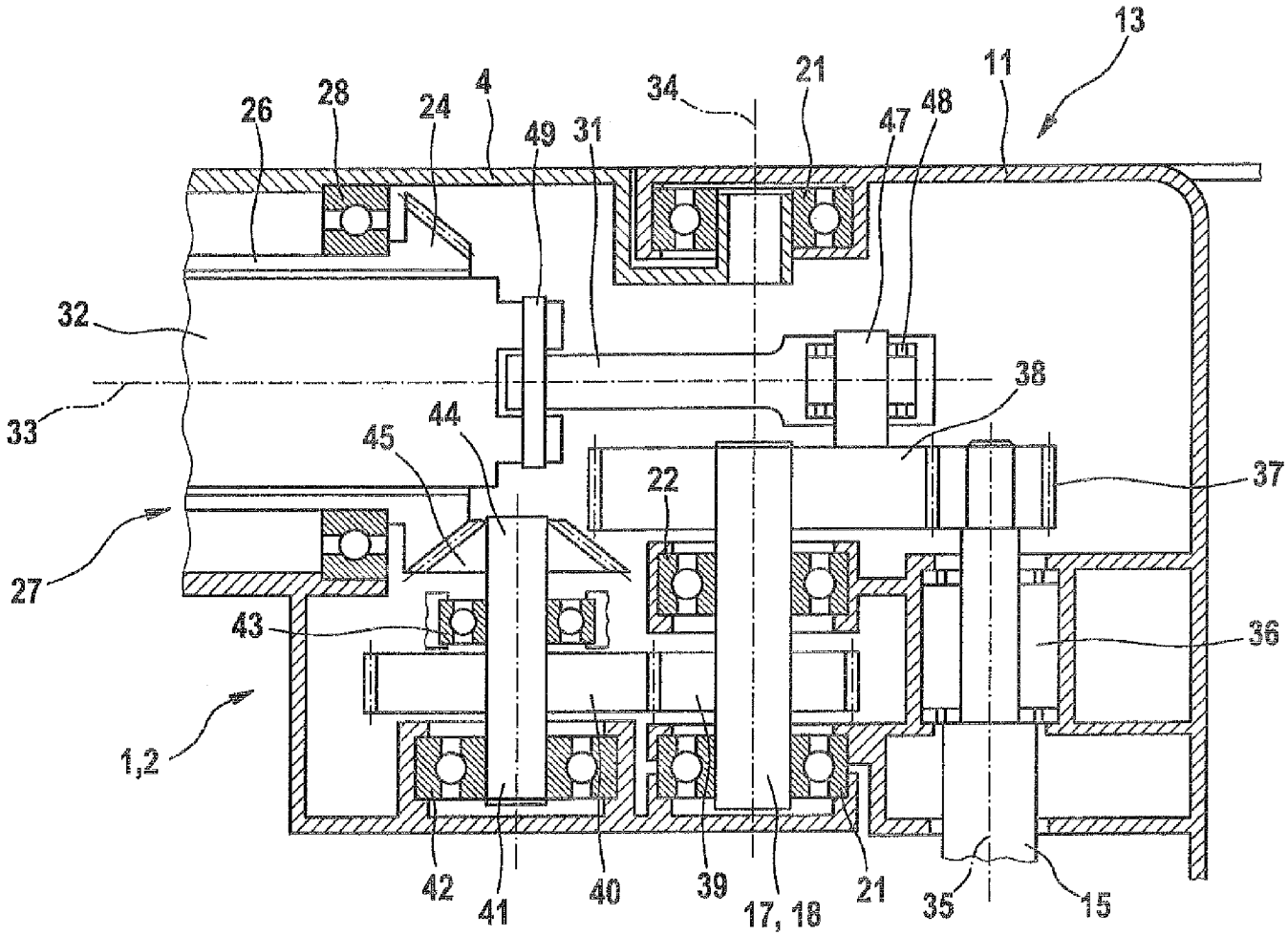
FIG. 3 shows a detail of an electric handheld power tool according to the invention in the region of the transmission in a second exemplary embodiment.

FIG. 3 shows the design of an electric handheld power tool 2 according to a second exemplary embodiment that largely corresponds to the first exemplary embodiment in FIG. 2; only the differences will be discussed below. The electric handheld power tool 2 of the second exemplary embodiment is an electric handheld power tool with an L design. In it, the center axis 35 of the drive shaft 15 is perpendicular to a pivoting plane of the electric handheld power tool 2. The drive housing part 11 of the electric handheld power tool 2 according to the exemplary embodiments in FIGS. 2 and 3 contains the drive motor, not shown, as well as all of the electrical components of the electric handheld power tool 2. The drive shaft 15 is supported in a roller bearing 36 and, by means of a spur gear 37, drives the shaft 18 embodied as a crankshaft 17. In order to execute the pivoting motion of the second machine unit 6 in relation to the first machine unit 3 (FIG. 1), the bearings 21 each support a respective half of the drive housing part 11 and the impact mechanism housing part 4. A bearing 22 in the drive housing part 11 serves as a counterpart bearing to provide further support for the crankshaft 17. The rotary motion of the drive spindle is introduced by means of a spur gear 39 affixed to the crankshaft 17 and is first transmitted to the spur gear 40 that is a component of an intermediate shaft 41. This intermediate shaft 41 is mounted in bearings 42, 43. At its front end 44, a bevel gear 45 meshes with the ring gear 24 mounted onto the hammer tube 26, which is supported in a bearing 28. The ring gear 24 affixed to the hammer tube 26 extends the drive train of the drive pinion to the tool holder 5 (FIG. 1). A spur gear 38 is fixed for co-rotation to the end of the crank shaft 17 in order to produce the hammering motion of the impact mechanism 27. This spur gear 38 drives the connecting rod 31 via a crank pin 47 that is mounted eccentrically in relation to the center axis 34. A low-friction bearing 48 provides a high degree of efficiency in the transmission of the rotary motion. The rotation of the crank pin 47 is transmitted to the piston 32 via the connecting rod 31, which is supported in rotatable fashion by means of a pin 49. The piston 32 executes the reciprocating motion, which is required for the hammering action, in the direction of the movement axis 33 in order to drive a striking element, not shown, of the impact mechanism 27. The components that are situated in the impact mechanism housing part 4 include: for the drilling drive, the shaft 41 with the spur gear 40, bevel gear 45, and bearings 43, 42, the ring gear 24 with the hammer tube 26, and the other components for driving the tool that are not shown in the drawing; the bearings 21 for each half of the "pivoting" function; and for the hammering drive, the piston 32 with the pin 49. The center axis 34 of the shaft 18 embodied as a crankshaft 17 represents the intersecting point for the pivot drive.

In both exemplary embodiments (FIGS. 2 and 3), clutches for selectively driving the working spindle and the hammer tube 26 and/or the piston 32 of the impact mechanism 27 are not shown. If the electric handheld power tool 2 is embodied, for example, in the form of a switchable rotary hammer with a drilling and/or hammering function, then correspondingly switchable clutches are provided.

The foregoing relates to the preferred exemplary embodiments of the invention, it being understood that other variants and embodiments thereof are possible within the spirit and scope of the invention, the latter being defined by the appended claims.

The invention claimed is:

1. An electric handheld power tool designed as a rotary hammer, a percussion hammer, or a rotary and percussion hammer, comprising:

an electric drive motor having a drive shaft;

a transmission driven by the drive shaft, having a transmission shaft; and an impact mechanism connected to the transmission, wherein a center axis of the transmission shaft or a center axis of the drive shaft constitutes a pivot axis around which the electric motor is able to pivot in order to reduce the overall length of the electric handheld power tool wherein the center axis of the drive shaft is arranged perpendicular to a pivoting plane of the drive motor.

2. The electric handheld power tool as recited in claim 1, further comprising a drive spindle connected to the transmission.

3. An electric handheld power tool designed as a rotary hammer, a percussion hammer, or a rotary and percussion hammer, comprising:

an electric drive motor having a drive shaft;

a transmission driven by the drive shaft, having a transmission shaft; and an impact mechanism connected to the transmission, wherein a center axis of the transmission shaft or a center axis of the drive shaft constitutes a pivot axis around which the electric motor is able to pivot in order to reduce the overall length of the electric handheld power tool, and further comprising a drive spindle connected to the transmission, and further comprising at least one clutch so that either or both of the drive spindle and the impact mechanism can be selectively connected to the drive motor.

4. The electric handheld power tool as recited in claim 3, further comprising a housing that is composed of a drive housing part containing the drive motor and an impact mechanism housing part containing the drive spindle and impact mechanism.

5. The electric handheld power tool as recited in claim 4, wherein the transmission is associated with both the drive housing part and the impact mechanism housing part.

6. The electric handheld power tool as recited in claim 5, further comprising a hinge, which is provided between the drive housing part and impact mechanism housing part to allow the drive motor to pivot.

7. The electric handheld power tool as recited in claim 6, wherein the drive spindle and impact mechanism have a common movement axis around which the drive spindle rotates and along which a hammering mass of the impact mechanism moves.

8. The electric handheld power tool as recited in claim 7, wherein the movement axis is oriented perpendicular to the pivot axis.

9. The electric handheld power tool as recited in claim 8, wherein the center axis of the drive shaft is arranged perpendicular to a pivoting plane of the drive motor.

10. The electric handheld power tool as recited in claim 8, wherein the center axis of the drive shaft is arranged parallel to a pivoting plane of the drive motor.

11. The electric handheld power tool as recited in claim 4, further comprising a hinge, which is provided between the drive housing part and impact mechanism housing part to allow the drive motor to pivot.

12. The electric handheld power tool as recited in claim 11, wherein the center axis of the drive shaft is arranged perpendicular to a pivoting plane of the drive motor.

13. The electric handheld power tool as recited in claim 11, wherein the center axis of the drive shaft is arranged parallel to a pivoting plane of the drive motor.

14. The electric handheld power tool as recited in claim 4, wherein the drive spindle and impact mechanism have a common movement axis around which the drive spindle rotates and along which a hammering mass of the impact mechanism moves.

15. The electric handheld power tool as recited in claim 14, wherein the movement axis is oriented perpendicular to the pivot axis.

16. The electric handheld power tool as recited in claim 3, wherein the drive spindle and impact mechanism have a common movement axis around which the drive spindle rotates and along which a hammering mass of the impact mechanism moves.

17. The electric handheld power tool as recited in claim 16, wherein the movement axis is oriented perpendicular to the pivot axis.

18. The electric handheld power tool as recited in claim 16, wherein a component, in particular a hammer tube, of the impact mechanism constitutes at least part of the drive spindle.

19. The electric handheld power tool as recited in claim 3, wherein the center axis of the drive shaft is arranged parallel to a pivoting plane of the drive motor.

20. The electric handheld power tool as recited in claim 3, wherein a component, in particular a hammer tube, of the impact mechanism constitutes at least part of a drive spindle.

* * * * *